US008752917B1

(12) United States Patent
Chang et al.

(10) Patent No.: US 8,752,917 B1
(45) Date of Patent: Jun. 17, 2014

(54) BALL BUSHING POSITIONING STRUCTURE OF A SLIDING RAIL ASSEMBLY FOR SERVER

(71) Applicant: GSLIDE Corporation, New Taipei (TW)

(72) Inventors: Te-Jeng Chang, New Taipei (TW); Sung-Mu Chiang, New Taipei (TW)

(73) Assignee: GSLIDE Corporation, Taipei Hsien (TW)

( * ) Notice: Subject to any disclaimer, the term of this patent is extended or adjusted under 35 U.S.C. 154(b) by 0 days.

(21) Appl. No.: 13/733,269

(22) Filed: Jan. 3, 2013

(51) Int. Cl.
*A47B 95/00* (2006.01)

(52) U.S. Cl.
USPC ..... 312/333; 312/334.47

(58) Field of Classification Search
CPC ..... A47B 88/10
USPC ..... 312/333, 334.44, 334.45, 334.46, 312/334.47, 319.1; 384/18, 21
See application file for complete search history.

(56) References Cited

U.S. PATENT DOCUMENTS

| | | | | |
|---|---|---|---|---|
| 5,181,782 | A * | 1/1993 | Wojcik | 384/21 |
| 5,626,406 | A * | 5/1997 | Schmid | 312/334.28 |
| 6,390,575 | B1 * | 5/2002 | Chen et al. | 312/334.46 |
| 6,450,600 | B1 * | 9/2002 | Chen et al. | 312/334.46 |
| 6,585,335 | B2 * | 7/2003 | Hwang et al. | 312/333 |
| 6,851,773 | B2 * | 2/2005 | Chen et al. | 312/334.46 |
| 6,860,574 | B2 * | 3/2005 | Hwang et al. | 312/334.44 |
| 6,860,575 | B2 * | 3/2005 | Chen et al. | 312/334.46 |
| 6,899,408 | B2 * | 5/2005 | Chen et al. | 312/334.44 |
| 6,997,611 | B2 * | 2/2006 | Chen et al. | 384/21 |
| 7,090,319 | B2 * | 8/2006 | Milligan et al. | 312/334.46 |
| 7,178,888 | B2 * | 2/2007 | Judge et al. | 312/334.46 |
| 7,611,213 | B2 * | 11/2009 | Wu et al. | 312/334.44 |
| 7,648,214 | B2 * | 1/2010 | Chen et al. | 312/334.47 |
| 7,699,415 | B2 * | 4/2010 | Tseng et al. | 312/333 |
| 7,798,583 | B2 * | 9/2010 | Yang et al. | 312/334.46 |
| 7,878,607 | B2 * | 2/2011 | Huang et al. | 312/334.46 |
| 8,485,616 | B2 * | 7/2013 | Chen et al. | 312/333 |
| 8,500,223 | B2 * | 8/2013 | Lacarra | 312/334.45 |
| 8,528,999 | B2 * | 9/2013 | Chen et al. | 312/334.45 |
| 8,534,782 | B2 * | 9/2013 | Yu et al. | 312/333 |
| 2002/0089272 | A1 * | 7/2002 | Liang et al. | 312/333 |
| 2003/0062812 | A1 * | 4/2003 | Hwang et al. | 312/334.34 |
| 2008/0159670 | A1 * | 7/2008 | Huang et al. | 384/18 |
| 2009/0058242 | A1 * | 3/2009 | Holcomb | 312/334.29 |
| 2009/0169140 | A1 * | 7/2009 | Chen et al. | 384/21 |

* cited by examiner

*Primary Examiner* — Darnell Jayne
*Assistant Examiner* — Kimberley S Wright
(74) *Attorney, Agent, or Firm* — Cook Alex Ltd.

(57) ABSTRACT

A ball bushing positioning structure formed of a sliding rail, a carrier rail, a ball bushing, a release hook and a release control member is disclosed. When inserting the sliding rail with an affixed server into the ball bushing to a certain distance to release stop edges of upright guide walls of a retaining flange of the release hook from the stop walls of the ball bushing subject to the effect of the release control member, the ball bushing is moved with the sliding rail backwardly relative to the carrier rail, preventing falling of the server with the sliding rail out of the carrier rail and avoiding impact between the sliding rail and the ball bushing.

6 Claims, 14 Drawing Sheets

BALL BUSHING POSITIONING STRUCTURE OF A SLIDING RAIL ASSEMBLY FOR SERVER

BACKGROUND OF THE INVENTION

1. Field of the Invention

The present invention relates to sliding rail assemblies and more particularly, to a ball bushing positioning structure of a sliding rail assembly for server, which uses a release hook to stop a ball bushing in a carrier rail positively in position and allows the ball bushing to be moved with a sliding rail upon insertion of the sliding rail into the carrier rail.

2. Description of the Related Art

Conventional two-stage or three-stage sliding rail assemblies for drawer commonly uses a ball bushing to smoothen sliding movement between two rails. When inserting one first rail, for example, a sliding rail, into a second rail, for example, carrier rail, after a maintenance or repair work, the sliding rail must be kept in alignment with the carrier rail accurately so that the sliding rail can be coupled to the ball bushing. To avoid impact damage of the ball bushing during insertion of the sliding rail, a ball bushing positioning design is necessary. FIGS. 1 and 2 illustrate a ball bushing positioning structure according to the prior art, which was invented by the present inventor. As illustrated, the carrier rail 7 comprises a guide block 71 having a hooked portion 711; the carrier rail 7 defines a slot 72. When the ball bushing 8 is moved with the sliding rail (not shown) out of the carrier rail, the front end 81 of the ball bushing 8 will force downward the hooked portion 711 into the slot 72 of the carrier rail 7, allowing the front end 81 of the ball bushing 8 to move over the hooked portion 711. After the front end 81 of the ball bushing 8 passes over the hooked portion 711, the hooked portion 711 will be engaged into a locating hole 82 of the ball bushing 8 to lock the ball bushing 8 to the carrier rail 7 (see FIG. 2). However, because the server is heavy and its weight can reach 20 kgs, the sliding rail may impact the ball bushing 8 if it is not kept in perfect alignment with the carrier rail 7 during its insertion into the ball bushing 8, and the server may fall with the sliding rail out of the carrier rail 7 during installation.

SUMMARY OF THE INVENTION

The present invention has been accomplished under the circumstances in view. It is therefore the main object of the present invention to provide a ball bushing positioning structure of a sliding rail assembly for server, which enables stop edges of a release hook to be disengaged from a ball bushing subject to the effect of a release control member upon insertion of a sliding rail into the ball bushing at a carrier rail so that the ball bushing can be further moved with the sliding rail smoothly relative to the carrier rail, avoiding falling of an affixed server with the sliding rail out of the carrier rail during installation.

It is another object of the present invention to provide a ball bushing positioning structure of a sliding rail assembly for server, which prevents impact between the sliding rail and the ball bushing during installation, prolonging the lifespan of the sliding rail assembly.

To achieve these and other objects of the present invention, a ball bushing positioning structure of a sliding rail assembly for server, a ball bushing positioning structure comprises a sliding rail affixed to a server for slidably coupling to a carrier rail, a carrier rail, which comprises a bottom wall and a slot cut through the bottom wall near a front side thereof, a ball bushing, which is movably set between the sliding rail and the carrier rail and carries a plurality of spaced rolling balls, comprising an opening, a narrow mouth defined in a front side of the opening, opposing left and right stop edges bilaterally and transversely disposed between the opening and the narrow mouth and opposing left and right guide edges respectively and obliquely outwardly extended from the left and right stop edges at two opposite lateral sides relative to the narrow mouth, a release hook, which has a front side thereof affixed to the carrier rail and a rear side thereof terminating in a protruding hook tail and a retaining flange at opposite left and right sides relative to the hook tail, the retaining flange comprising two upright guide walls respectively spaced from the hook tail by a gap and two stop edges respectively located at respective front sides of the upright guide walls, the protruding hook tail being stoppable at a bottom surface of the bottom wall of the carrier rail to force the hook tail into the slot of the carrier rail, and a release control member affixed to the sliding rail at a selected location for forcing the hook tail of the release hook into the slot of the carrier rail to cause disengagement of the stop edges of the release hook from the stop edges of the ball bushing after insertion of the sliding rail into the ball bushing and the carrier rail during installation.

DETAILED DESCRIPTION OF THE INVENTION

Figure 1:
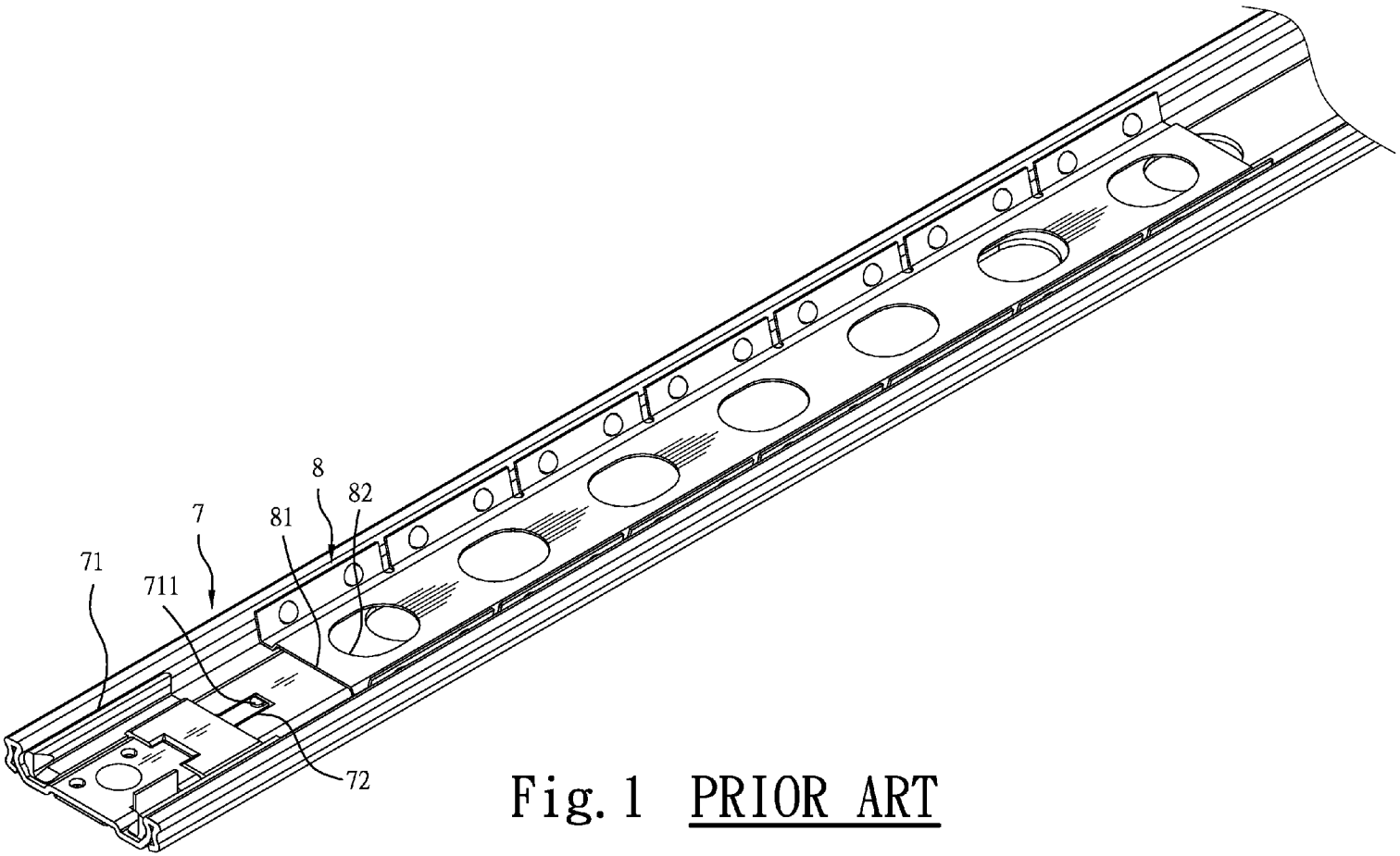
Fig. 1 PRIOR ART
FIG. 1 is an elevational view of a ball bushing positioning structure used in a sliding rail assembly for server according to the prior art.
Figure 2:
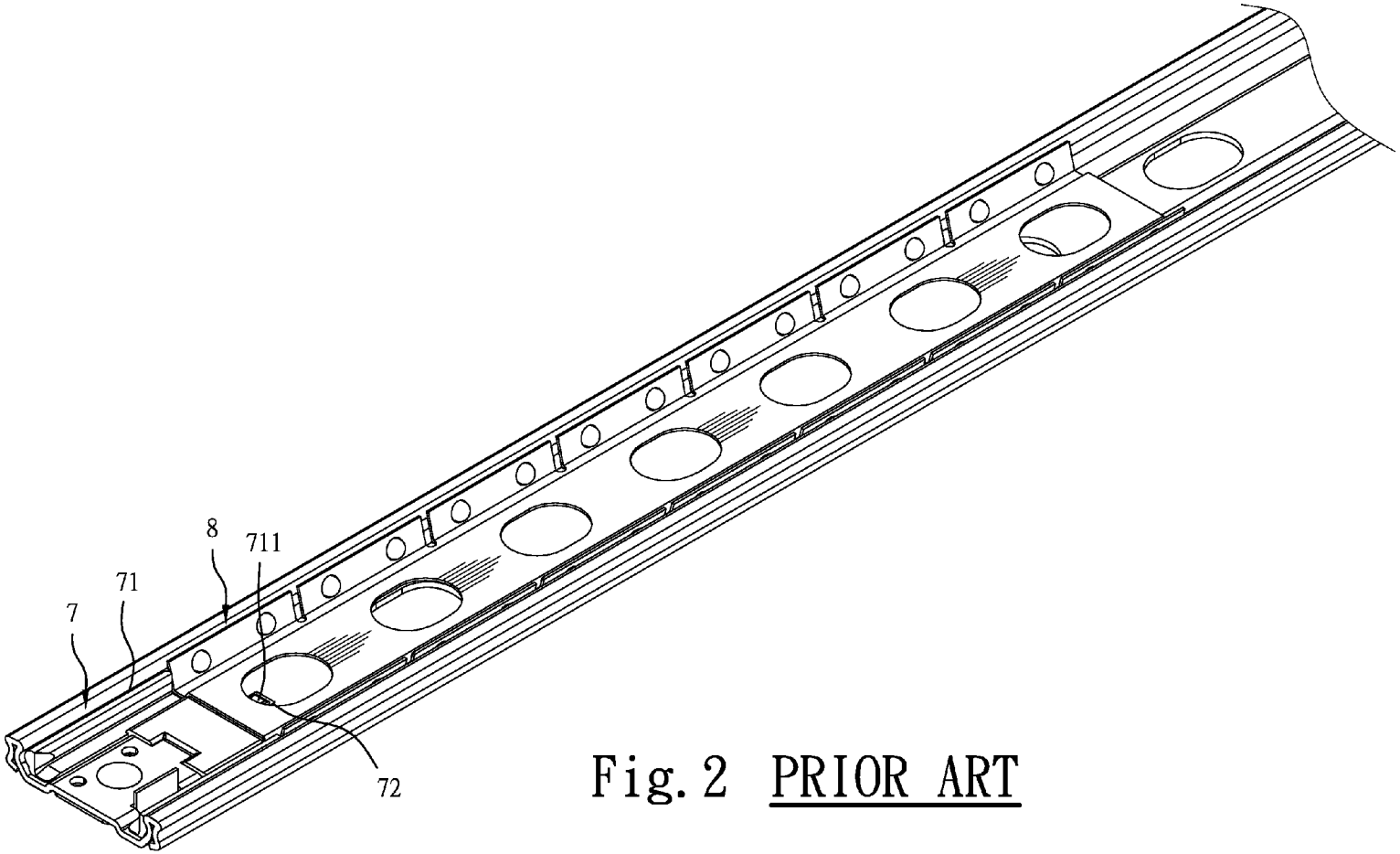
Fig. 2 PRIOR ART
FIG. 2 corresponds to FIG. 1, illustrating the ball bushing set in position.
Figure 3:
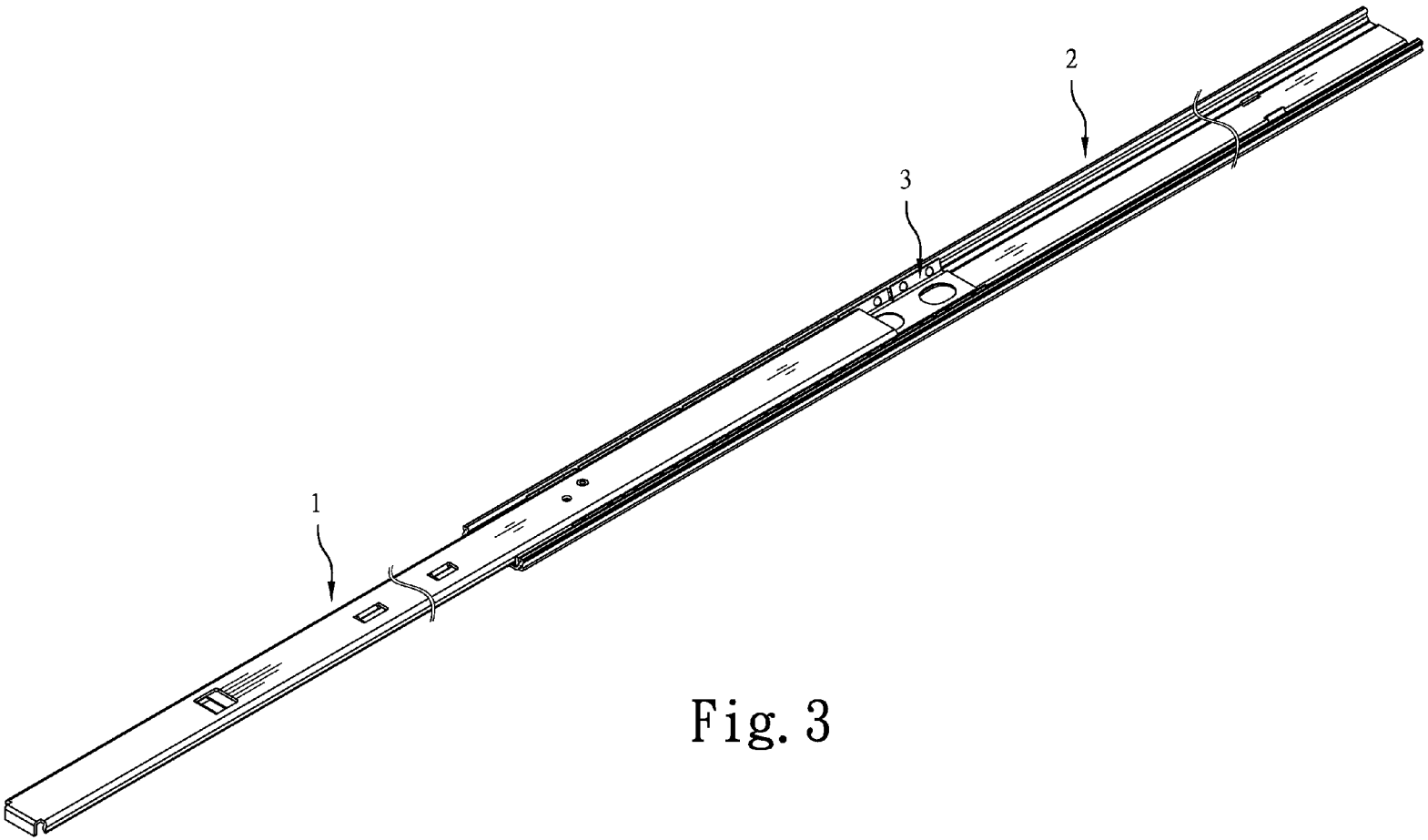
FIG. 3 is an elevational view of a ball bushing positioning structure of a sliding rail assembly for server in accordance with the present invention.
Figure 4:
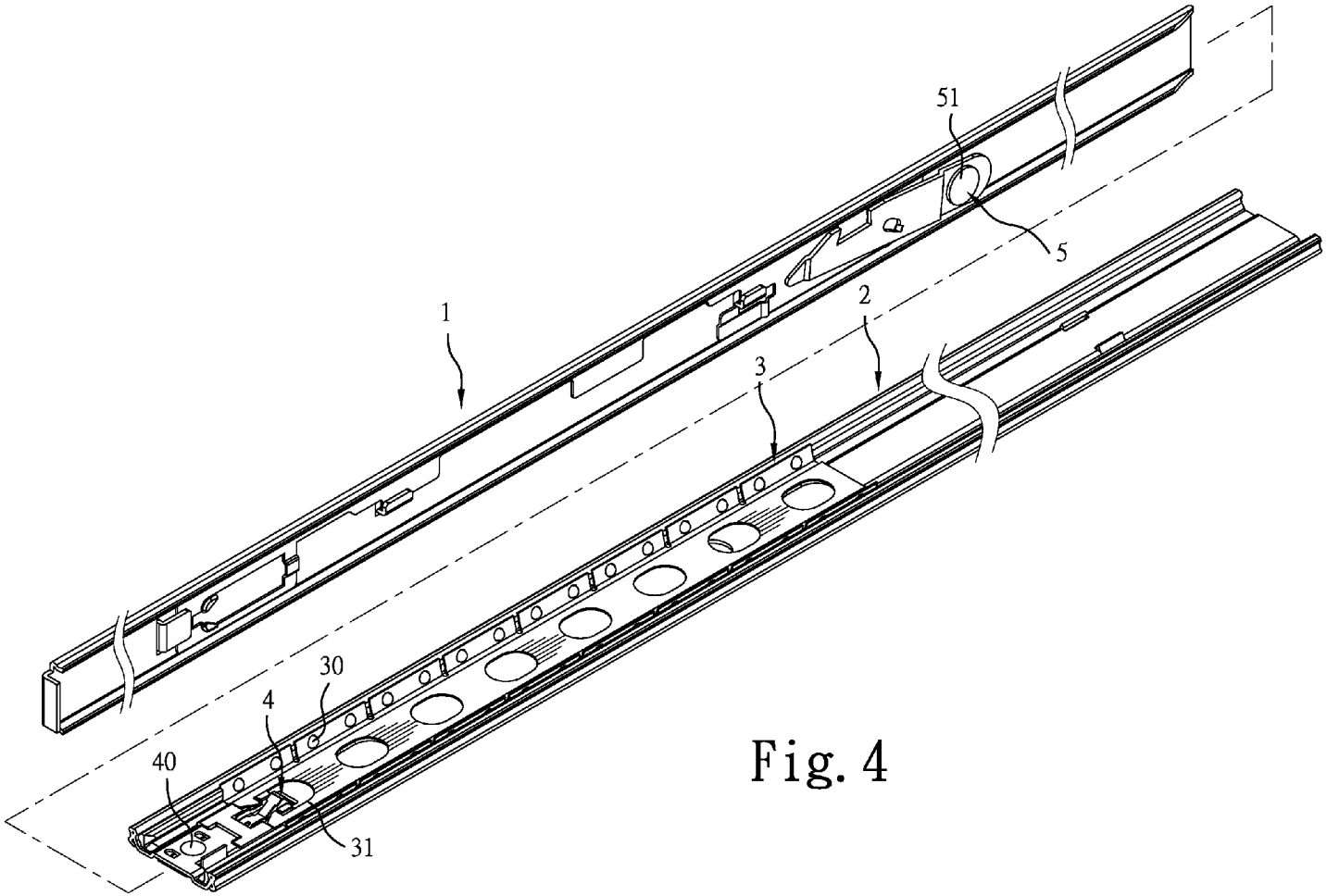
FIG. 4 is an exploded view of the sliding rail assembly for server in accordance with the present invention.
Figure 5:
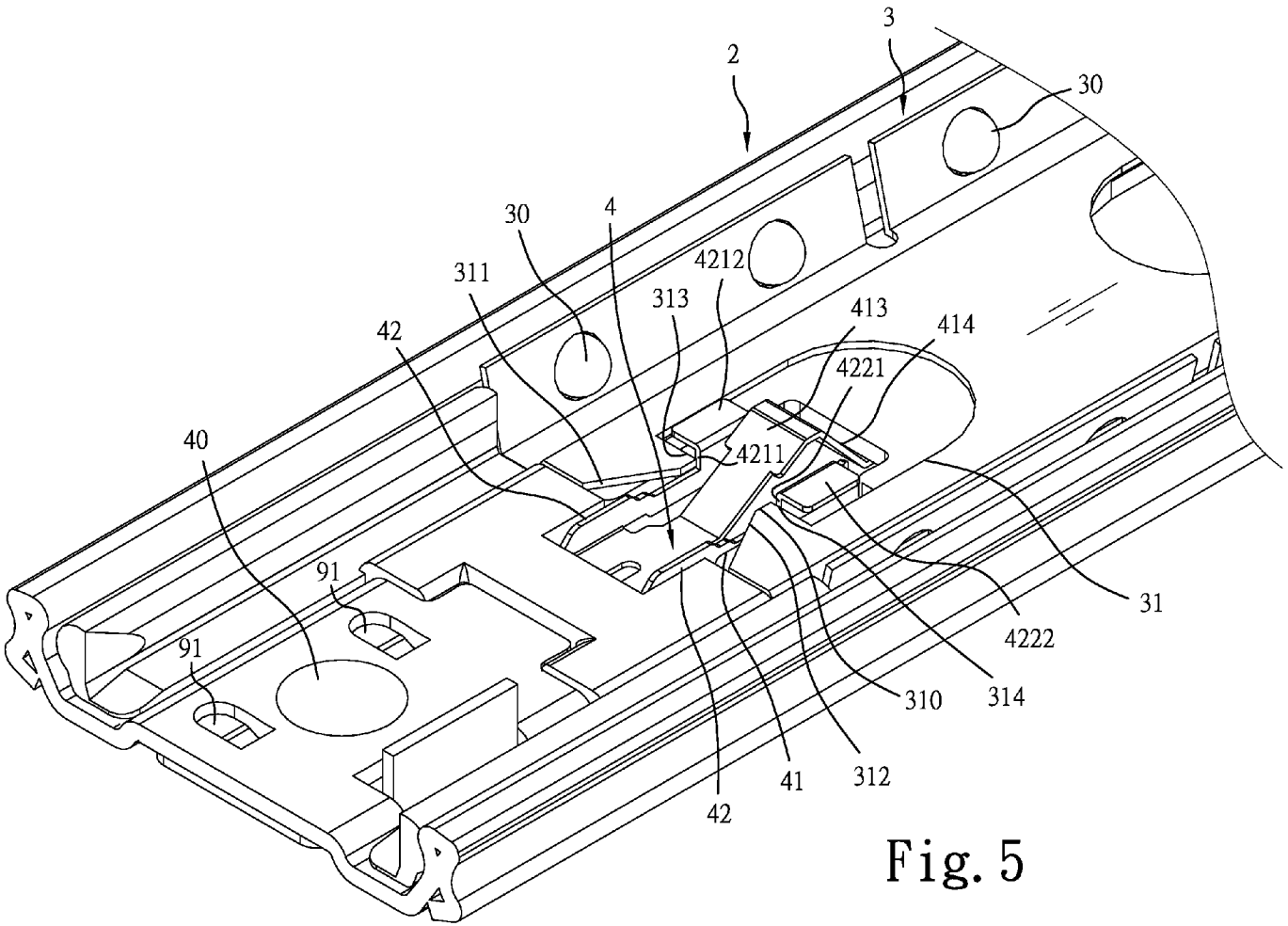
FIG. 5 is an enlarged view of a part of the ball bushing positioning structure in accordance with the present invention.

Referring to FIGS. 3-14, a ball bushing positioning structure of a sliding rail assembly for server in accordance with the present invention is shown, comprising a sliding rail 1, a carrier rail 2, a ball bushing 3, a release hook 4, and a release control member 5.

The sliding rail 1 is affixed to a server (not shown) and movable back and forth relative to the carrier rail 2.

Figure 6:
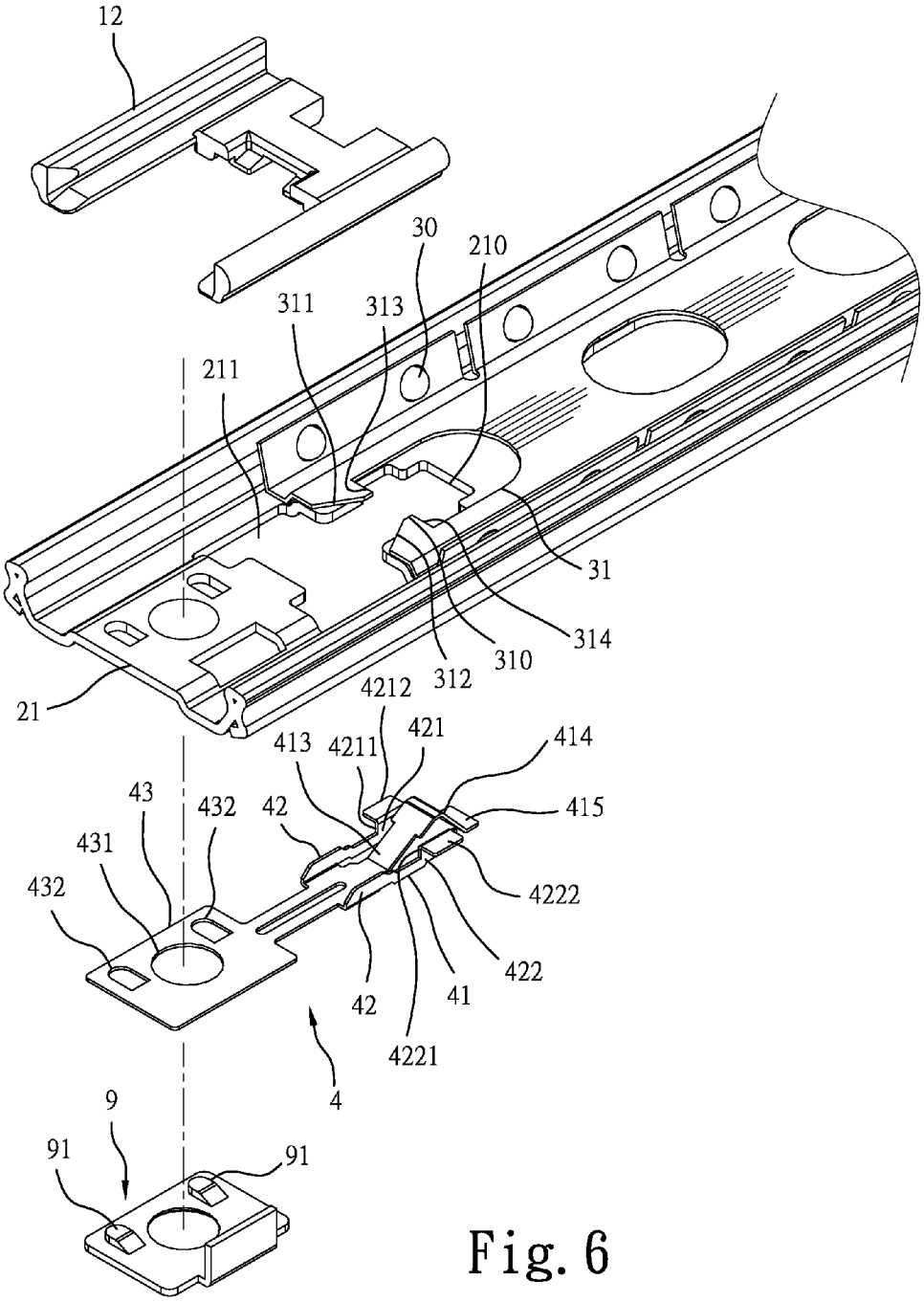
FIG. 6 is an exploded view of the part of the ball bushing positioning structure shown in FIG. 5.

The ball bushing 3 (see FIGS. 4-5 and FIGS. 10-12) is movably mounted between the sliding rail 1 and the carrier rail 2 to guide sliding movement of the sliding rail 1 smoothly. As seen in FIG. 6, ball bushing 3 carries a plurality of rolling balls 30 at predetermined intervals, and includes an opening 31, a narrow mouth 310 defined in a front side of the opening 31, opposing left and right stop edges 313;314 bilaterally and transversely disposed between the opening 31 and the narrow mouth 310, and opposing left and right guide edges 311;312 respectively and obliquely outwardly extended from the left and right stop edges 313;314 at two opposite lateral sides relative to the narrow mouth 310.

The release hook 4 has its front side affixed to the carrier rail 2 by a fastening member, for example, rivet 40, and its rear side terminating in a protruding hook tail 41 (see FIGS. 6-8) and a retaining flange 42 at opposite left and right sides relative to the hook tail 41. The retaining flange 42 comprises two upright guide walls 421;422 respectively spaced from the hook tail 41 by a gap 10 (see FIG. 9), and two stop edges 4211;4221 respectively located at the respective front sides of the upright guide walls 421;422. The protruding hook tail 41 defines a front slope portion 413 sloping upwardly backwards, a limiter strip 415, and a rear slope portion 414 sloping downwardly backwards from the topmost edge of the front slope portion 413 and terminating in the limiter strip 415. The release hook 4 is preferably made out of a resilient metal sheet member using a stamping technique.

The carrier rail 2 comprises a base wall 21, a slot 211 cut through the base wall 21 near a front side thereof for receiving the hook tail 41 and retaining flange 42 of the release hook 4 wholly or partially (see FIG. 6). The limiter strip 415 of the hook tail 41 of the release hook 4 is stoppable at the bottom surface 210 of the bottom wall 21 of the carrier rail 2 adjacent to the slot 211 so that the hook tail 41 of the release hook 4 is constrained to engage into the slot 211.

The release control member 5 (see FIGS. 4 and 12-14) is affixed to the sliding rail 1 at a selected location. When attaching the ball bushing 3 and the carrier rail 2 to the sliding rail 1, the rear side 51 of the release control member 5 is pressed on the hook tail 41 of the release hook 4 to force the hook tail 41 and the retaining flange 42 into the slot 211 of the carrier rail 2, thereby releasing the stop edges 4211;4221 (see FIG. 6) of the release hook 4 from the opposing left and right stop walls 313;314 of the ball bushing 3. Further, in the present preferred embodiment, the release control member 5 can be formed of the rivet of the sliding rail 1 that affixed the release hook. Alternatively, the release control member 5 can be formed of a part of the sliding rail 1 using a stamping technique.

When detaching the server for maintenance or inspection, the server and the affixed sliding rail 1 are moved out of the carrier rail 2. During sliding movement of the sliding rail 1 relative to the carrier rail 2, the ball bushing 3 is synchronously moved with the sliding rail 1. At this time, the opposing left and right guide edges 311;312 of the ball bushing 3 are respectively stopped against the rear of upright guide walls 421;422 of the release hook 4, forcing the upright guide walls 412;422 to deflect inward in a direction toward the opposing left and right sides 411;412 (see FIGS. 9-10), and thus the left and right guide edges 311;312 can slide over the upright guide wall 421;422. After passed, the upright guide walls 421;422 immediately return to their former shape subject to their resilient material property. At this time, the front stop edges 4211;4221 of the upright guide wall 421;422 are stopped against the opposing left and right stop edges 313;314 of the ball bushing 3 (see FIGS. 5 and 11), keeping the ball bushing 3 in place while the sliding rail is fully removed from the ball bushing 3 and carrier rail 2. Further, when going to attach the server with the sliding rail 1 to the ball bushing 3 and the carrier rail 2, the sliding rail 1 is inserted into the ball bushing 3 to a certain distance to force the rear side 51 of the release control member 5 at the sliding rail 1 against the hook rail 41 of the release hook 4, moving the hook tail 41 and retaining flange 42 of the release hook 4 into the slot 211 at the bottom wall 21 of the carrier rail 2. At this time, the stop edges 4211;4221 of the upright guide walls 421;422 of the retaining flange 42 are disengaged from the stop walls 313;314 of the ball bushing 3, allowing the ball bushing 3 to be moved with the sliding rail 1 backwardly toward the inside of the carrier rail 2.

Further, the release hook 4 comprises two opposing top walls 4212;4222 respectively outwardly extended from the upright guide walls 421;422 at right angles.

Figure 7:
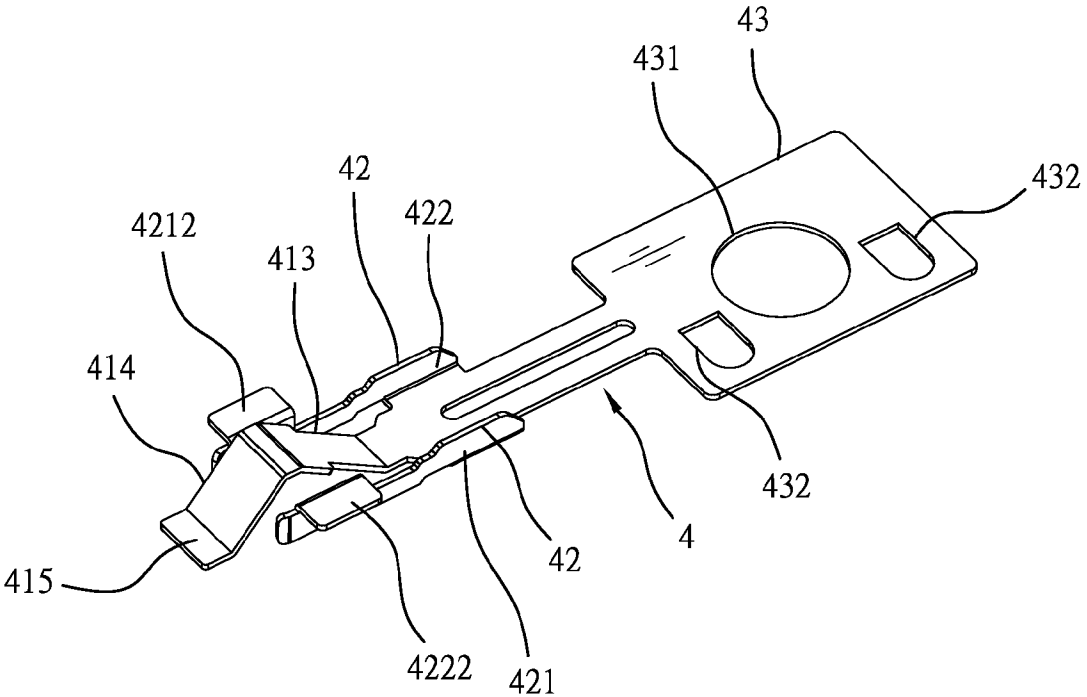
FIG. 7 is an elevational view of the release hook in accordance with the present invention.
Figure 8:
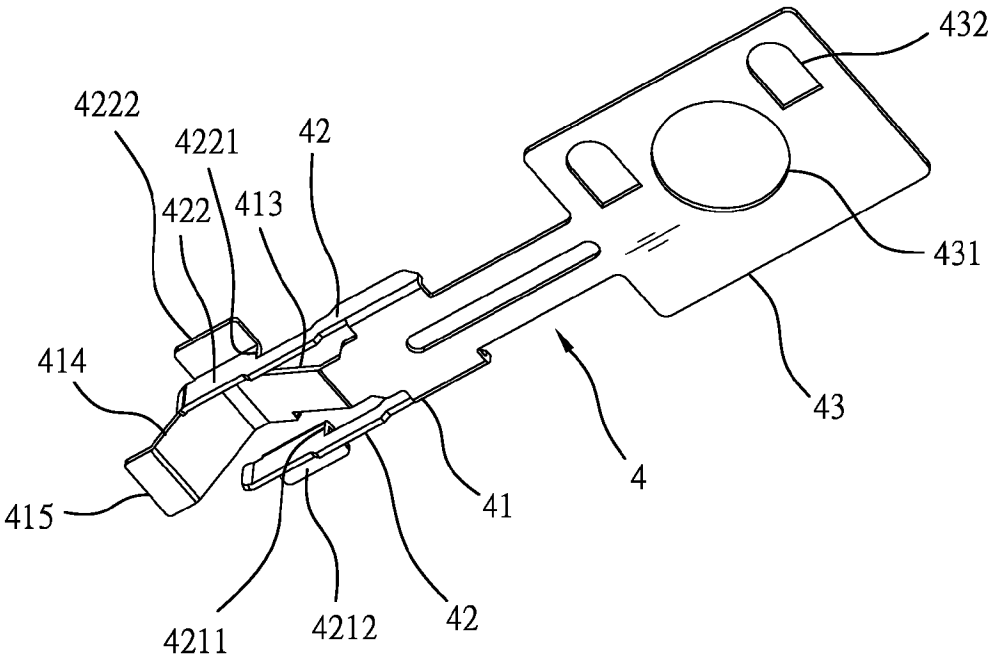
FIG. 8 corresponds to FIG. 7 when viewed from another angle.
Figure 9:
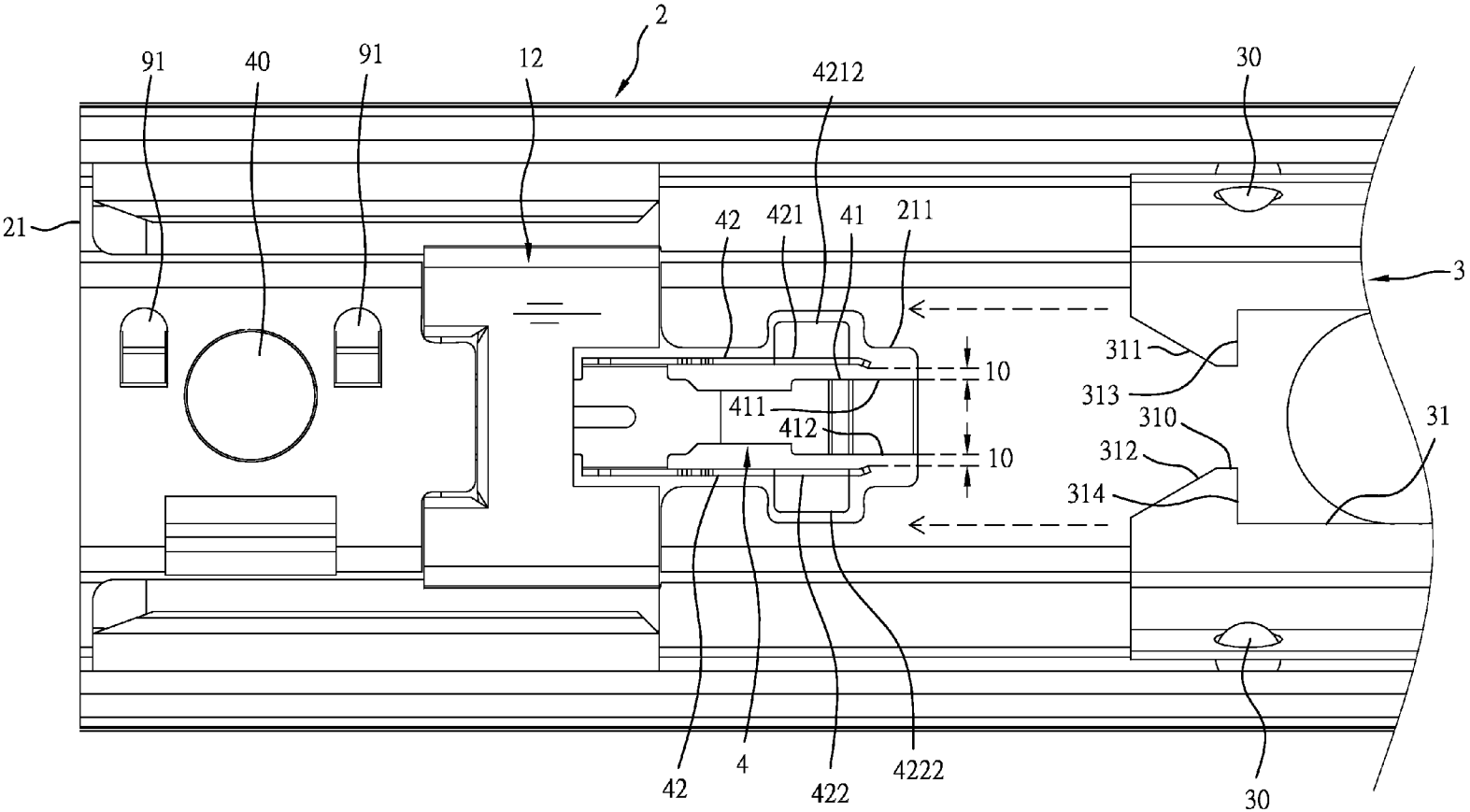
FIG. 9 is a schematic top view of the present invention illustrating the opposing guide edges of the ball bushing kept apart from the opposing upright guide walls of the release hook.
Figure 10:
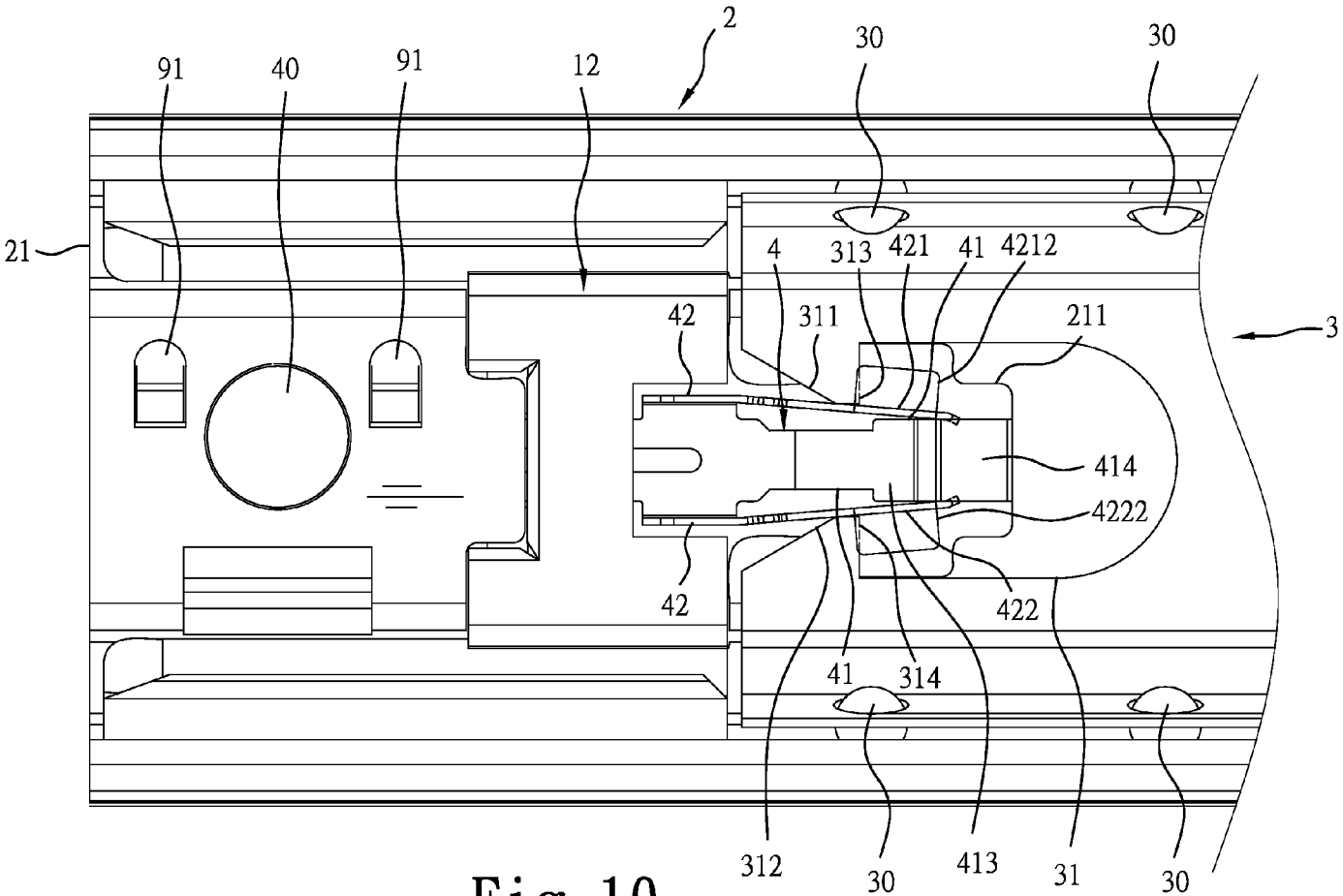
FIG. 10 corresponds to FIG. 9, illustrating the guide edges of the ball bushing respectively forced against the upright guide walls of the release hook.
Figure 11:
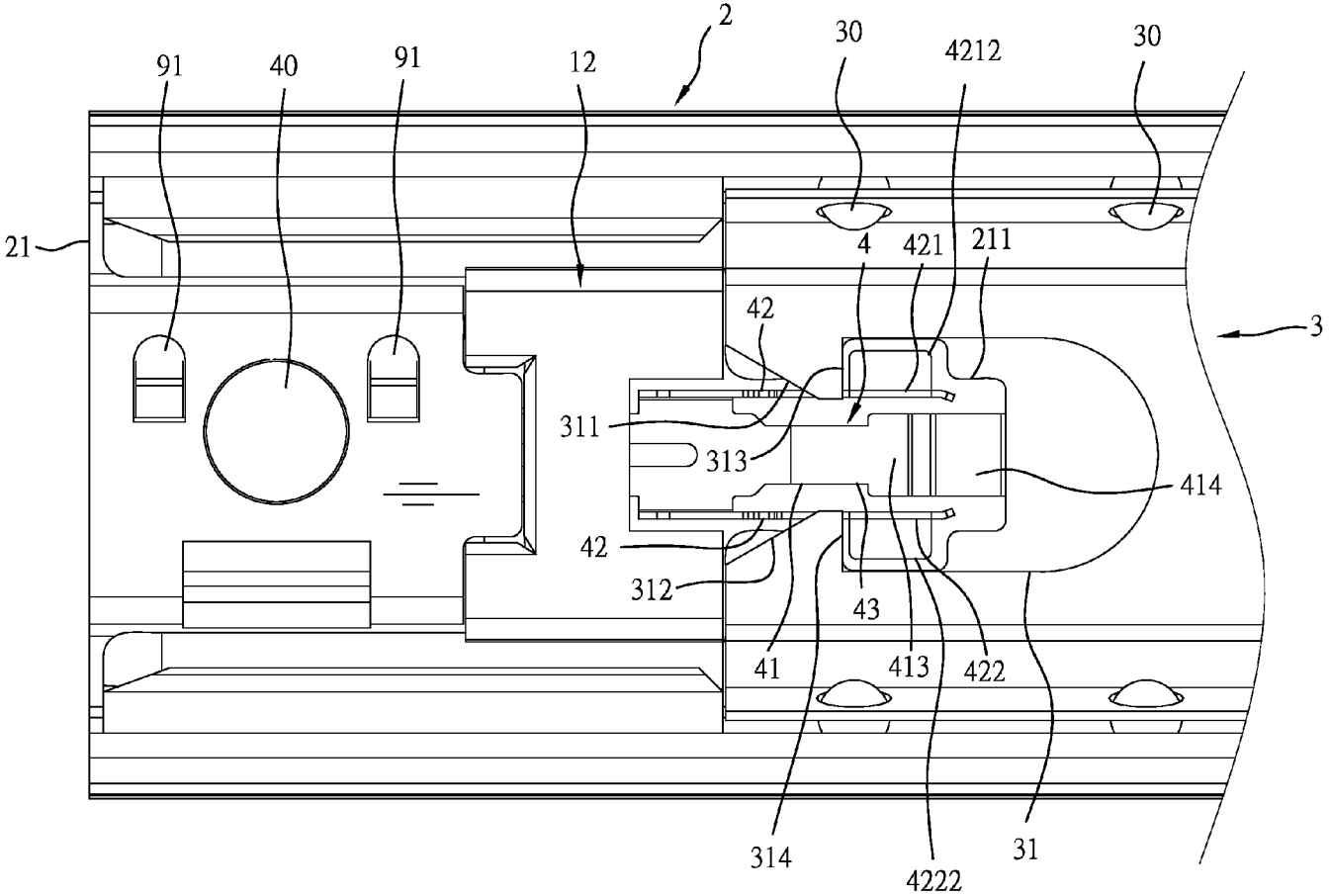
FIG. 11 corresponds to FIG. 10, illustrating the guide edges of the ball bushing moved over the upright guide walls of the ball bushing and stopped at the stop walls of the ball bushing.
Figure 12:
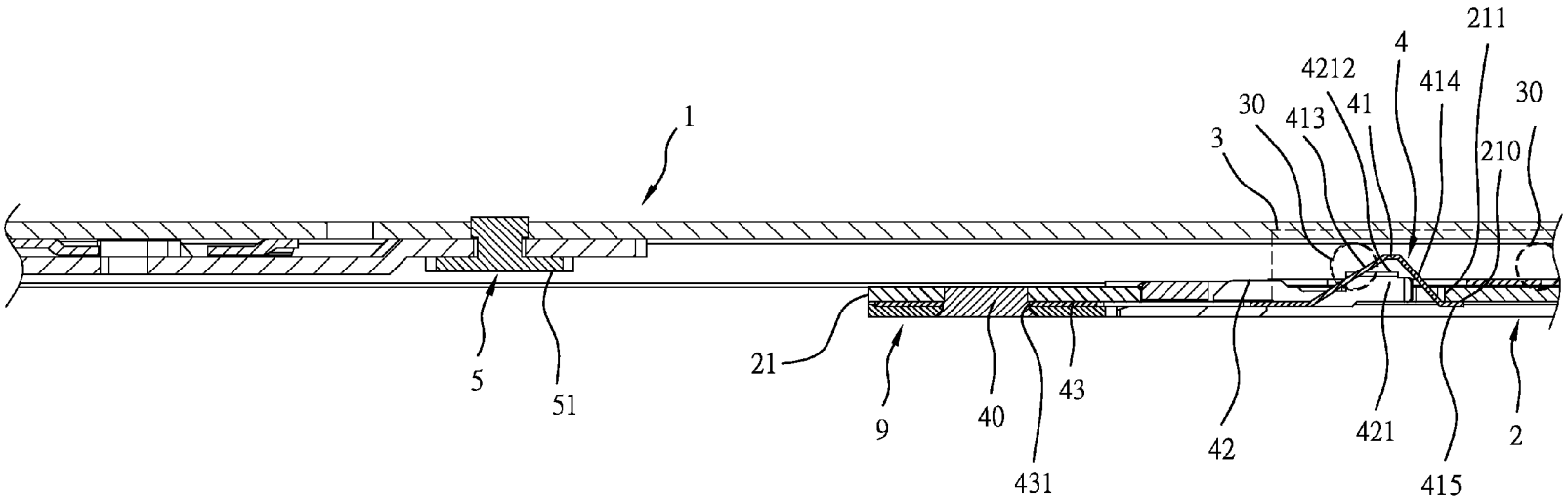
FIG. 12 is a sectional side view of the present invention, illustrating the sliding rail inserted into the ball bushing and the release control member kept away from the release hook.
Figure 13:
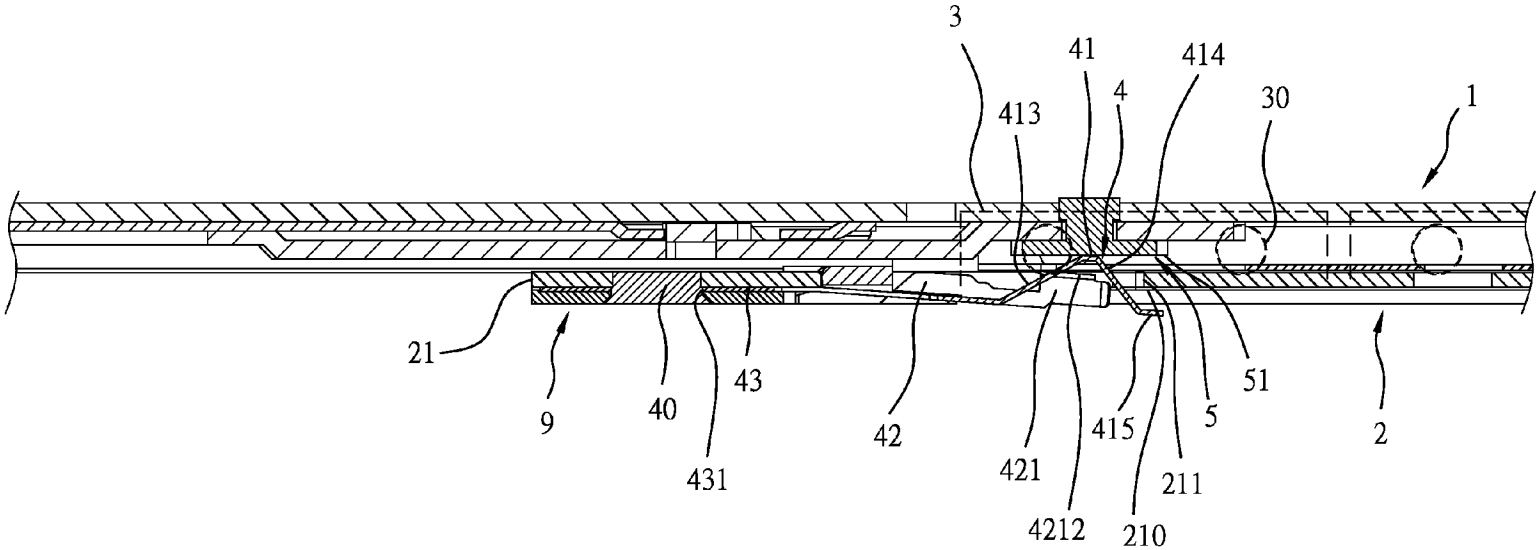
FIG. 13 corresponds to FIG. 12, illustrating the release control member pressed on the release hook.
Figure 14:
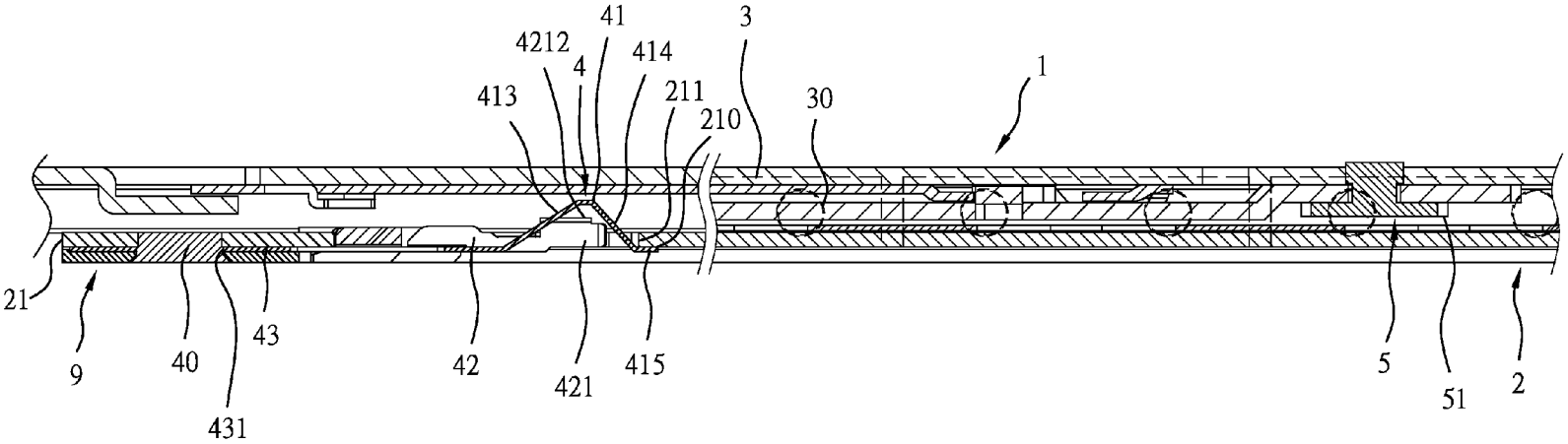
FIG. 14 corresponds to FIG. 13, illustrating the release control member pressed on the release hook and the ball bushing moved with the sliding rail backwardly relative to the carrier rail.

Further, the release hook 4 has the front side thereof terminating in a mounting plate 43 (see FIGS. 6-8). The mounting plate 43 comprises a through hole 431 that permits the mounting plate 43 to be affixed to the carrier rail 2 by a fastening member, for example, rivet 40 (see FIG. 9) and a clamping plate 9 (see FIG. 6), and a plurality of locating holes 432 respectively engaged with respective raised portions 91 of the clamping plate 9 (see FIGS. 6-8).

Further, the aforesaid carrier rail 2 comprises a guide block 12 located at the front side thereof for guiding the sliding rail 1 in and out of the carrier rail 2.

In conclusion, the invention provides a ball bushing positioning structure of a sliding rail assembly for server, which has the advantages and features as follows:

1. During installation, the sliding rail 1 is inserted with the affixed server into the ball bushing 3 to a certain distance to release the stop edges 4211;4221 of the upright guide walls 421;422 of the retaining flange 42 from the stop walls 313;314 of the ball bushing 3 subject to the effect of the release control member 5, enabling the ball bushing 3 to be moved with the sliding rail 1 backwardly relative to the carrier rail 2, preventing falling of the server with the sliding rail 1 out of the carrier rail 2 due to improper insertion of the sliding rail 1 into the ball bushing 3.
2. The structural design of the ball bushing positioning structure prevents the sliding rail 1 from impacting the ball bushing 3 during installation, prolonging the lifespan of the sliding rail assembly.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A ball bushing positioning structure, comprising:

a sliding rail configured to be affixed to a server for slidably coupling to a carrier rail;

a carrier rail comprising a bottom wall, and a slot cut through said bottom wall near a front side thereof;

a ball bushing movably set between said sliding rail and said carrier rail and carrying a plurality of spaced rolling balls, said ball bushing comprising an opening, a narrow mouth defined in a front side of said opening, opposing rearward facing left and right stop edges bilaterally and transversely disposed between said opening and said narrow mouth, and opposing left and right guide edges respectively and obliquely outwardly extended forwardly from said left and right stop edges at two opposite lateral sides relative to said narrow mouth;

a release hook having a front side thereof affixed to said carrier rail and a rear side thereof terminating in a protruding hook tail and a retaining flange at opposite left and right sides relative to said hook tail, said retaining flange comprising two upright guide walls respectively spaced from said hook tail by a gap and two stop edges respectively located at respective front sides of said upright guide walls, said protruding hook tail being stoppable at a bottom surface of said bottom wall of said carrier rail to force said hook tail into said slot of said carrier rail; and a release control member affixed to said sliding rail at a selected location for forcing said hook tail of said release hook into said slot of said carrier rail to cause disengagement of the stop edges of said release hook from the stop edges of said ball bushing after insertion of said sliding rail into said ball bushing and said carrier rail during installation.

2. The ball bushing positioning structure as claimed in claim 1, wherein said release hook further comprises two stop walls respectively outwardly extended from said upright guide walls at right angles.

3. The ball bushing positioning structure as claimed in claim 1, wherein said release hook further comprises a mounting plate at the front side thereof, said mounting plate comprising a through hole affixed to said carrier rail by a rivet and a clamping plate.

4. The ball bushing positioning structure as claimed in claim 3, wherein said mounting plate of said release hook further comprises a plurality of locating holes; said clamping plate comprising a plurality of raised portions respectively engaged with said locating holes of said mounting plate.

5. The ball bushing positioning structure as claimed in claim 1, wherein said hook tail of said release hook further comprises a front slope portion sloping upwardly backwards, and a rear slope portion sloping downwardly backwards from the topmost edge of said front slope portion.

6. The ball bushing positioning structure as claimed in claim 5, wherein said hook tail of said release hook further comprises a limiter strip located at a rear side thereof for stopping at the bottom surface of said bottom wall of said carrier rail to force said hook tail into said slot of said carrier rail.

* * * * *